US005472310A

United States Patent [19]

Frank

[11] Patent Number: 5,472,310

[45] Date of Patent: Dec. 5, 1995

[54] SEPARATING DEVICE

[75] Inventor: Werner Frank, Reichnau, Germany

[73] Assignee: Licentia Patent-Verwaltungs-GmbH, Frankfurt am Main, Germany

[21] Appl. No.: 224,744

[22] Filed: Apr. 7, 1994

[30] Foreign Application Priority Data

Apr. 7, 1993 [DE] Germany ..... 43 11 390.7
Aug. 24, 1993 [DE] Germany ..... 43 28 434.5

[51] Int. Cl.[6] ..... B65H 3/14

[52] U.S. Cl. ..... 414/798.9; 271/98; 271/150

[58] Field of Search ..... 414/798.9, 903; 271/98, 150

[56] References Cited

U.S. PATENT DOCUMENTS

| | | | |
|---|---|---|---|
| 3,193,283 | 7/1965 | Smith | 271/47 |
| 3,253,825 | 5/1966 | Buchwald | 271/26 |
| 4,177,982 | 12/1979 | Bewersdorf et al. | 271/150 X |
| 4,526,359 | 7/1985 | Garavuso | 271/98 X |
| 4,708,333 | 11/1987 | Servi et al. | 271/98 X |
| 4,725,052 | 2/1988 | Nakanishi | 414/798.9 X |
| 5,255,905 | 10/1993 | Reid et al. | 271/98 X |

FOREIGN PATENT DOCUMENTS

| | | | |
|---|---|---|---|
| 566918 | 12/1932 | Germany | 271/98 |
| 1274391 | 8/1963 | Germany . | |
| 1204242 | 12/1963 | Germany . | |
| 1270849 | 10/1964 | Germany . | |
| 1285227 | 6/1965 | Germany . | |
| 2351644 | 10/1973 | Germany . | |
| 2521933 | 5/1975 | Germany . | |
| 3447777A1 | 12/1984 | Germany . | |
| 4013082C2 | 4/1990 | Germany . | |
| 81838 | 3/1990 | Japan | 271/98 |
| 583068 | 12/1977 | U.S.S.R. . | |

*Primary Examiner*—David A. Bucci
*Attorney, Agent, or Firm*—Spencer, Frank & Schneider

[57] ABSTRACT

A device for separating flat parcels from a stack of parcels includes a drawing element that travels in a conveying direction and acts by friction on a parcel to be drawn off from the stack of parcels. A guide wall for the stacked parcels forms a gap with the drawing element for a drawn off parcel to pass through. A support surface supports the stack of parcels and generates a stack pressure in a direction of the drawing element. At least one first nozzle disposed in the region of the support surface, and/or the region of the guide wall, blows compressed air between the parcels in the stack. At least one second nozzle, disposed in the region of the gap, between the stack of parcels and the guide wall, blows compressed air having a predetermined inclination counter to the conveying direction of the parcels to be drawn off.

9 Claims, 3 Drawing Sheets

SEPARATING DEVICE

CROSS REFERENCE TO RELATED APPLICATION

This application claims the priority of German Applications Nos. P 43 28 434.5 filed Aug. 24, 1993, and P 43 11 390.7 filed Apr. 7, 1993, both of which are incorporated herein by reference.

BACKGROUND OF THE INVENTION

1. Field of the Invention

The invention relates to the field of separating devices for separating flat parcels, such as letters, documents and the like, from a stack, and in particular to an apparatus using a drawing element that travels in a conveying direction and acts by means of friction on a respective parcel to be drawn off.

2. Background Information

Separation methods and devices are known from, for example, European Patent EP 0,142,538. One known problem associated with separation methods and devices is the so-called double-drawing error. This error occurs when in addition to a desire first parcel to be drawn off of a stack, a further second parcel is drawn off. This problem may be due to the frictional force between the first parcel in the stack and the second parcel being too great, or because the second parcel protrudes and is drawn off too early due to an insufficiently uniform alignment of the front edges of the parcels.

The above-described problem is to a degree a function of parameters such as the parcel features, i.e., particularly weight, thickness, roughness and moisture content of the parcel material, as well as environmental conditions, in particular the amount of moisture in the ambient air.

SUMMARY OF THE INVENTION

It is therefore an object of the present invention to provide a device for separating parcels, by means of which the prior art problems are reduced, particularly with regard to achieving a reduction of the double-drawing rate and, in addition, to achieving an optimum loosening of the parcels, even moist parcels and those which may possibly be sticking together.

This object is attained in accordance with the invention wherein a device for separating flat parcels includes nozzles for blowing compressed air between the stacked parcels disposed in the region of a support surface or in the region of a guide wall, and at least one additional nozzle is disposed in the region of a passage opening between the stacked parcels and the guide wall.

In particular, in one embodiment, the device for separating flat parcels from a stack of parcels includes a drawing element that travels in a conveying direction and acts by friction on a parcel to be drawn off from the stack of parcels. A guide wall for the stacked parcels forms a gap with the drawing element for a drawn off parcel to pass through. A support surface supports the stack of parcels and generates a stack pressure in a direction of the drawing element. At least one first nozzle disposed in the region of the support surface, and/or the region of the guide wall, blows compressed air between the parcels in the stack. At least one second nozzle, disposed in the region of the gap, between the stack of parcels and the guide wall, blows compressed air having a predetermined inclination counter to the conveying direction of the parcels to be drawn off.

With these nozzles, compressed air having a predetermined inclination can be blown counter to the conveying direction of the parcels. The parcels are thereby loosened in the parcel stack, even in the case of moist parcel material and where there is ambient air having a high humidity content.

BRIEF DESCRIPTION OF THE DRAWINGS

Further advantageous features of the invention will become apparent from the detailed description of the preferred embodiments taken with the drawings in which.

DETAILED DESCRIPTION OF THE PREFERRED EMBODIMENTS

The invention will now be described in more detail by example with reference to the embodiments shown in the Figures. It should be kept in mind that the following described embodiments are only presented by way of example and should not be construed as limiting the inventive concept to any particular physical configuration.

Figure 1:
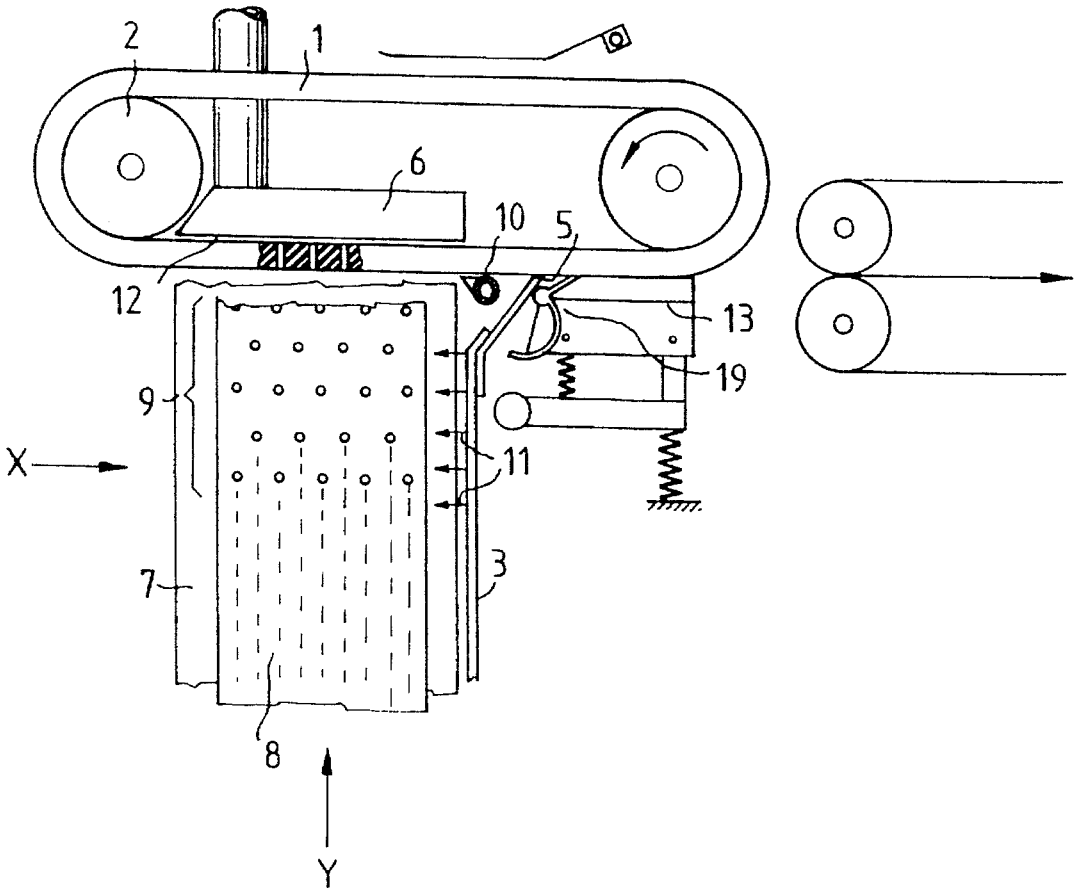
FIG. 1 is a general, overhead view of an embodiment of a device in accordance with the invention.

FIG. 1 shows a top view of one embodiment of a device according to the invention. This embodiment includes a drawing element having, for example, a plurality of drawing belts 1 extending parallel and guided by a roller 2. A guide wall 3 is provided for front edges of the stacked parcels 4 which are to be conveyed through a passage opening (gap) 5 formed by the guide wall 3 and the drawing element. An aspiration element 6 is provided for generating a vacuum on the side of the drawing element, by means of which the pressing force between the front parcel in the stack 4 and the drawing element is increased.

The drawing belts 1 are coated with a material that has a high coefficient of friction. The drawing belts 1 may also have holes as vacuum openings. The stacked parcels 4 are supported by a support surface 7, which may have a base belt 8. Nozzles 9, which blow compressed air between the parcels of the stack 4, are disposed in the region of the support surface 7.

Figure 2:
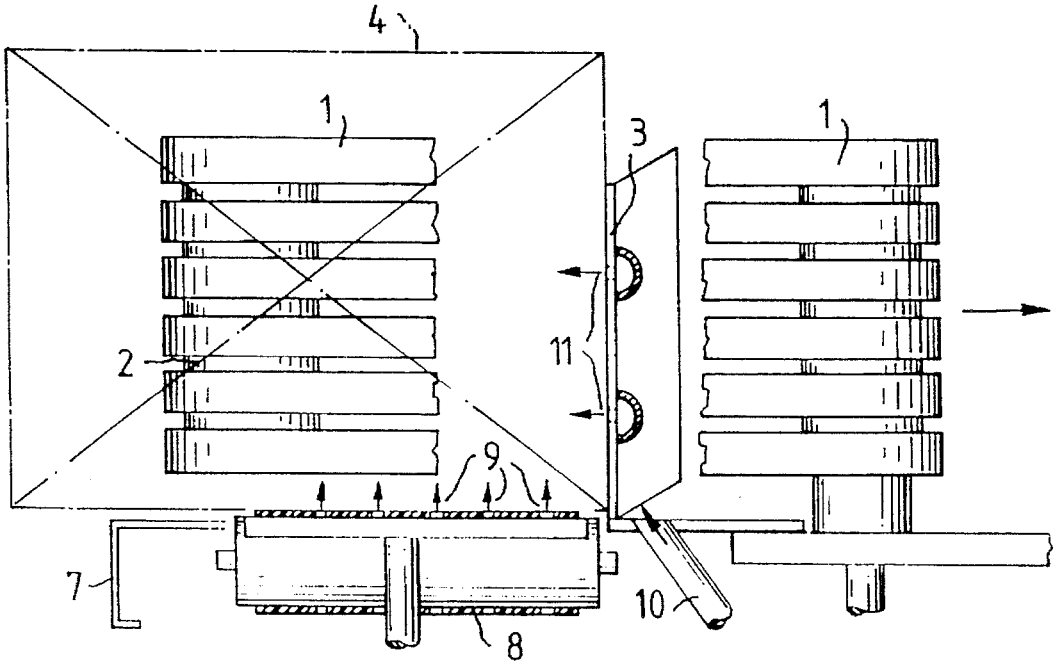
FIG. 2 is a view Y of the device of FIG. 1.

As shown in FIG. 2, these nozzles 9 are preferably inclined such that the air current is oriented approximately 0° to 20° in the direction of the parcel conveying direction. Nozzles 11, with which compressed air is blown between the parcels of the parcel stack, are likewise disposed in the region of guide wall 3, and can be inclined in a similar manner.

In the region of passage opening (gap) 5, guide wall 3 is curved in the conveying direction. In the open free-space region thus formed, compressed air is blown counter to the parcel course at an inclination of essentially 15° to 20° through one or a plurality of nozzles 10 disposed in the region of the support surface 7.

Figure 3:
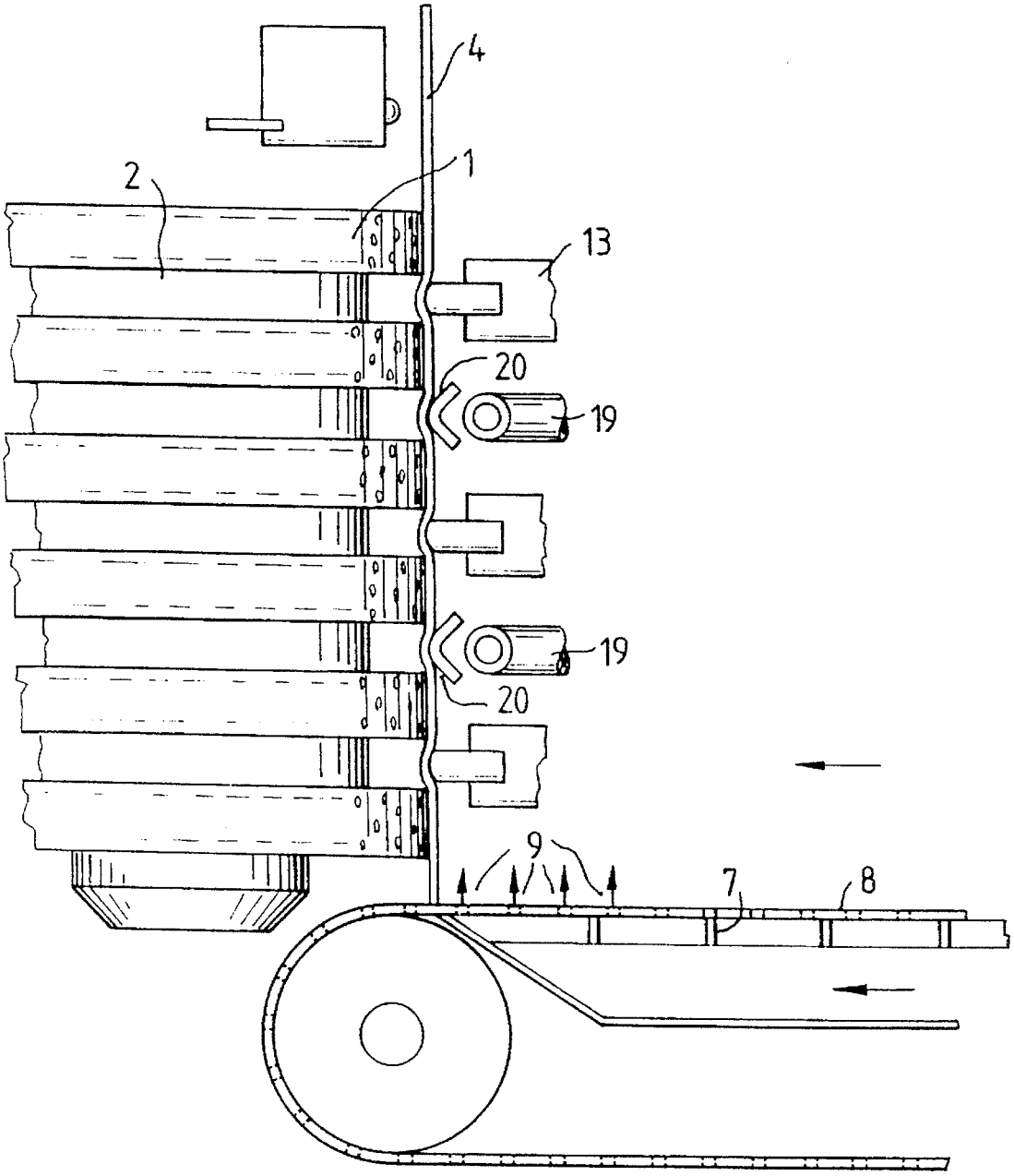
FIG. 3 is a view X of the device of FIG. 1.

Furthermore, as shown in FIG. 3, two or more nozzles 19 for stripping multiple parcels are disposed on the side of the passage gap 5 opposite the support surface 7.

Blowing nozzles 9, 10 in support surface 7 or in the base belt 8, and the nozzles in guide wall 3, cause the parcels to loosen in the initial stage of drawing.

Nozzles 19 disposed between strippers 13 have a blowing direction horizontally counter to the parcel stack and form an air cushion between the rear side of a parcel resting on the drawing belt 1 and the next parcel in the stack 4. An air cushion of this type is likewise formed by nozzles 10 disposed in the open free-space region at the inlet. The frictional relationships between the respective parcel to be drawn off at the moment and the next parcel still in the stack 4 are thus optimized in such a way that double-draw errors are extensively avoided.

Nozzles 9, 10, 11, 19 are, for example, supplied with blowing air from either a fan or a central air supply and which can be hot air. The air throughput, that is, the magnitude of the volume of the air current, is selected such that the stacked parcels are separated, but no damage is caused by the air current. The air throughput in the device according to the invention is started as soon as a stack of parcels 4 is stacked on support surface 7.

During stacking of the parcels by means of operating personnel, the possibility cannot be ruled out that the parcels will not be inserted so as to be oriented toward the front edge, and as the front edge of the parcels is increasingly displaced on guide sheet 3, the probability of double-draw errors increases. Because of this, it is advantageous to pre-draw the next parcel on the drawing belt 1, i.e., the respective parcel to be drawn, by means of an intermediate start of the drawing element 1 into a defined light barrier, and subsequently stop the drawing element again.

As shown in FIG. 1, aspiration block 6 with aspiration openings 12 is offset at the edge of guide sheet 3, counter to the letter conveying direction. At a great distance from guide wall 3, parcels offset counter to the parcel conveying direction are transported by means of an intermediate start into an intermediate position in which the offset does not exceed a predetermined value.

It is significant here that the parcel transported into the intermediate position not exert an excessive frictional force on the next parcel in the stack. This is assured by the air cushion produced by blowing nozzles 10, 19. Parcels that may possibly be carried along are held back by stripper 13. The restraining force of stripper 13 can be reduced to a minimum by means of the above-described measures, so that parcels are handled more gently during the drawing-off process, and very instable parcels can be separated out.

In any case, a parcel to be drawn off will be pre-drawn by means of the intermediate start so that the parcel is located in the front region between stripper 13 and drawing element 1. The frictional lockup required for drawing by means of belts that have a high coefficient of friction is assured during the actual start, that is, when the provided gap to the rear edge of the parcel traveling ahead has been reached. Even very unstable parcels are accelerated well because of this, and are not buckled transversely to their longitudinal axis by, for example, the restraining force of stripper 13. An increase in the longitudinal stability of instable parcels also results because the strippers 13 engage between the belts and thus cause a bending of the parcels along their longitudinal axis. A further increase in longitudinal stability can be achieved by providing spring-loaded guide shoes 20 that have an extremely low frictional coefficient disposed between the friction belts not already occupied by strippers 13.

I claim:

1. A device for separating flat parcels from a stack of parcels, comprising:

a drawing element that travels in a conveying direction and acts by friction on a parcel to be drawn off from the stack of parcels;

a guide wall for the stacked parcels, the guide wall forming a gap with the drawing element for a drawn off parcel to pass through, wherein the guide wall is curved in the conveying direction in a region of the gap;

a support surface for supporting the stack of parcels, the support surface including means for generating a stack pressure in a direction of the drawing element;

at least one first nozzle for blowing compressed air between the parcels in the stack, and disposed in a region of the support surface and being for blowing compressed air having an inclination range of essentially 15° to 20° from a perpendicular to the support surface, toward the drawing element; and at least one second nozzle disposed in the region of the gap, between the stack of parcels and the guide wall; for blowing compressed air having a predetermined inclination counter to the conveying direction of the parcels to be drawn off.

2. The device as defined in claim 1, wherein at least one first nozzle comprises a further first nozzle disposed in the support surface for blowing compressed air having an inclination range of essentially 0° to 15° from the perpendicular to the support surface, in the direction of the drawing element, the further first nozzle not being disposed in the region where the gap is curved in the conveying direction.

3. The device as defined in claim 1, wherein the support surface comprises a movable base belt, and wherein the at least one first nozzle comprises a plurality of nozzles arranged along the length of the support surface.

4. The device as defined in claim 1, wherein the compressed air comprises hot air.

5. A device for separating flat parcels from a stack of parcels, comprising:

a drawing element that travels in a conveying direction and acts by friction on a parcel to be drawn off from the stack of parcels, wherein the drawing element comprises:

at least two drawing belts, strippers disposed between the at least two drawing belts, for holding back following parcels by engaging the parcels between the drawing belts without touching the parcels;

a guide wall for the stacked parcels, the guide wall forming a gap with the drawing element for a drawn off parcel to pass through;

a support surface for supporting the stack of parcels, the support surface including means for generating a stack pressure in a direction of the drawing element;

at least one first nozzle for blowing compressed air between the parcels in the stack, and disposed in one of: a region of the support surface, and a region of the guide wall; and at least one second nozzle disposed in a region of the gap between the stack of parcels and the guide wall and disposed between the strippers, for blowing compressed air having a predetermined inclination counter to the conveying direction of the parcels to be drawn off.

6. The device as defined in claim 5, wherein the drawing belts comprise belts having holes therethrough which provide vacuum openings.

7. The device as defined in claim 5, wherein the device further comprises:

a plurality of further drawing belts; and spring-loaded guide shoes having an extremely low frictional coefficient disposed between ones of the drawing belts not occupied by strippers.

8. The device as defined in claim 5, wherein the support surface comprises a movable base belt, and wherein the at least one first nozzle comprises a plurality of nozzles arranged along the length of the support surface.

9. The device as defined in claim 5, wherein the compressed air comprises hot air.

* * * * *

UNITED STATES PATENT AND TRADEMARK OFFICE

CERTIFICATE OF CORRECTION

PATENT NO. : 5,472,310

DATED : December 5, 1995

INVENTOR(S) : Werner Frank

It is certified that error appears in the above-indentified patent and that said Letters Patent is hereby corrected as shown below:

On the title page, item [75], the inventor's city of residence should read --Reichenau--.

Signed and Sealed this

Thirtieth Day of January, 1996

*Attest:*

Bruce Lehman

BRUCE LEHMAN

*Attesting Officer*

*Commissioner of Patents and Trademarks*